US005490293A

United States Patent [19]

Nilsson

[11] Patent Number: 5,490,293

[45] Date of Patent: Feb. 13, 1996

[54] TRANSFER APPARATUS

[76] Inventor: Per Nilsson, Östra Rönneholmsvägen 26, S-211 47 Malmö, Sweden

[21] Appl. No.: 256,965

[22] PCT Filed: Feb. 2, 1993

[86] PCT No.: PCT/SE93/00080

§ 371 Date: Jul. 22, 1994

§ 102(e) Date: Jul. 22, 1994

[87] PCT Pub. No.: WO93/15705

PCT Pub. Date: Aug. 19, 1993

[30] Foreign Application Priority Data

Feb. 10, 1992 [SE] Sweden ..... 9200378

[51] Int. Cl.[6] ..... A61G 7/10

[52] U.S. Cl. ..... 5/83.1; 5/89.1; 5/86.1; 212/331; 212/330

[58] Field of Search ..... 5/81.1, 83.1–89.1; 212/328, 330–333, 73, 312, 327; 414/921

[56] References Cited

U.S. PATENT DOCUMENTS

| | | | |
|---|---|---|---|
| 1,971,294 | 8/1934 | Bunker | 5/89.1 |
| 3,123,224 | 3/1964 | Kral | 212/330 |
| 3,351,959 | 11/1967 | Turpin | 5/83 |
| 4,125,908 | 11/1978 | Vail et al. | 5/86 |
| 4,202,064 | 5/1980 | Joergensen | 5/83.1 |
| 4,256,098 | 3/1981 | Swan et al. | 5/81.1 X |
| 4,372,452 | 2/1983 | McCord | 212/331 X |
| 4,639,955 | 2/1987 | Carminati et al. | 5/81 B |
| 4,944,056 | 7/1990 | Schroeder et al. | 5/81.1 |
| 5,158,188 | 10/1992 | Nordberg | 212/312 |

FOREIGN PATENT DOCUMENTS

| | | |
|---|---|---|
| 0027638 | 4/1981 | European Pat. Off. . |
| 2354755 | 1/1978 | France . |
| 1-192355 | 8/1989 | Japan . |
| 8201163 | 10/1984 | Sweden . |
| 2195978 | 4/1988 | United Kingdom . |
| 8809159 | 12/1988 | WIPO . |

OTHER PUBLICATIONS

Patent Abstracts of Japan, vol. 13, No. 487, C–649, abstract of JP, A, 1–192355 (Kyushu Kobayashi Kensetsu K.K.), 2 Aug. 1989.

*Primary Examiner*—Michael F. Trettel
*Attorney, Agent, or Firm*—Ladas & Parry

[57] ABSTRACT

A method and apparatus for transferring a load (8) carried by a carrier member (12) between two mutually separate transport paths (3*a*, *b*). During transfer, the carrier member switches from being suspended by a device (4*a*) displaceable in the first carrier path (4*a*) to being suspended by a device (4*b*) displaceable in the second carrier path (3*b*). The carrier member (12) when it is suspended by a first connecting device (9*a*, 11*a*) from the displaceable device (4*a*) of the first conveyor path (4*a*), is connected to the displaceable device (4*b*) of the second conveyor path (3*b*) by a second connecting device (9*b*, 11*b*). The length of the second connecting device is reduced and the carrier member (12) is displaced thereby so as to be wholly suspended from the displacement device (4*b*) of the second conveyor path. A drive mechanism lengthens or shortens at least one of the connecting devices in relation to a housing (14) for modifying the distance between the carrier member (12) and the displaceable devices (4*a*, 4*b*).

12 Claims, 8 Drawing Sheets

TRANSFER APPARATUS

FIELD OF THE INVENTION

The present invention relates to a method and an apparatus for transferring loads.

BACKGROUND

In many contexts, there is a need to be able, in a simple manner, to transfer a depending load between to paths which are physically separate from one another. The term path is here taken to signify, for example, a track disposed to cooperate with a carriage running in the track. In its simplest design, the carriage consists, for example, of a wheel journalled in a bracket which, in its turn, is provided with a device to which the load is connected.

In particular for invalids and the infirm who are nursed in the home for shorter or longer periods of time, there is a need to be able to transfer or move such people sitting on a carrier which, in its turn, is displaced along a guide path provided in the ceiling of an apartment in which the person in question is staying. Partially handicapped people who live alone may also be in need of such assistance. One problem which occurs is that, in connection with door openings and the like, the path is discontinued by those wall portions which are located above the door openings. Since the need for auxiliary aids of the type disclosed here is many times relatively brief in duration, it is, from the economic point of view, naturally unreasonable to carry out those modifications to buildings required to be able to mount a continuous guide path in the ceiling.

SUMMARY OF THE INVENTION

An object of the invention is to provide a method and apparatus which avoids the problem of interrupted guide paths as explained above.

The present invention makes it possible to transport a patient along a guide path on a carrier device and thereafter connect the carrier device to another path which is physically separate from the first path. Such transfer can be controlled by a nurse and, in certain cases, by the patient unaided.

BRIEF DESCRIPTION OF THE DRAWINGS

The present invention will now be described in greater detail hereinbelow, with particular reference to the accompanying drawings, in which.

DETAILED DESCRIPTION

Figure 8:
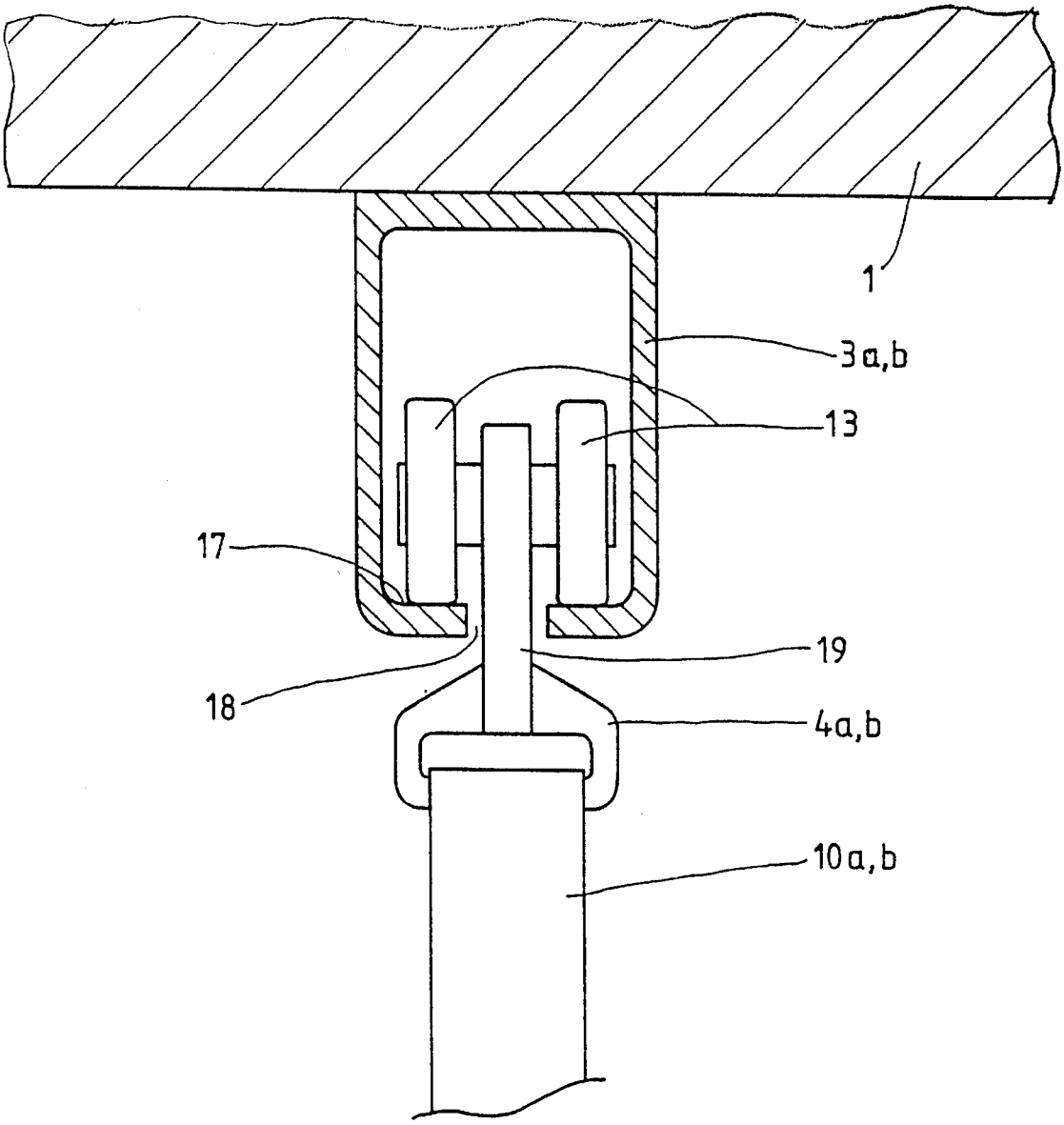
FIG. 8 is a cross-section through one embodiment of the path.

Referring to the Drawings, there is shown a ceiling 1 and a wall portion 2 above a door opening. A first conveyor path 3*a* is disposed on one side of the wall portion and a second conveyor path 3*b* on the other side of the wall portion. In the Figures, the conveyor paths are shown as guide rails with a groove 17. In FIG. 8, the path is shown in one embodiment in which it is of rectangular cross-section with a downwardly facing slot 18. A carriage 4*a,b* provided with wheels 13 runs in the path, the carriage being separate for each path. Hereinafter the carriages will generally be designated first carriage 4*a* and second carriage 4*b*. In the Figures the carriages are shown in one embodiment in which they are provided with a support member 19 which projects out through the slot 18. It will be obvious to a person skilled in the art that the path and the carriages may be given varying designs and appearances without departing from the scope of the invention.

Each respective carriage 4*a,b* is connected with an apparatus 7 which mounts a carrier member 12, for example a hook to which is coupled a chair, a harness or other suitable means in which a patient 8 may be placed. The apparatus is provided with two connecting devices 9*a*, 11*a*;9*b*, 11*b*, each one shown in one embodiment in which it comprises one connecting device 9*a,b* extending from the housing 14 of the apparatus. The apparatus includes drive means (not shown) for infeed and discharge of at least one of the connecting devices in relation to the housing 14 of the apparatus. The connecting devices 9*a,b* consist, in one preferred embodiment, of a strap, a chain or the like which, for example, at its upper end is provided with a connecting device 11*a,b*, for example a hook with which the connecting device is coupled to the carriage 4*a,b*. In FIGS. 1–5 the carriage is shown in one embodiment in which it is provided with an extension portion comprising a strap 10*a,b* depending from the carriage and which, at its lower end is provided with an interconnecting device 6*a,b* with which the connecting device 11*a,b* is coupled. A switch 5 is provided for switching between the positions indicated by A and B.

The apparatus is provided with operating devices 15,16, for example push buttons, for controlling drive means (not shown) for the infeed and discharge of the connecting devices 9*a*, 11*a*;9*b*, 11*b* in relation to the housing 14 of the apparatus. By infeed and discharge of the connecting devices, the distance between the carrier member 12 and the coupling devices 11*a,b* are modified and thereby, also the distance between the carrier member 12 and the carriages 4*a,b*. The position of the switch 5 is determinative of whether the connecting devices are fed in or paid out when the operating devices 15,16 are actuated. As a rule, the connecting devices 9*a,b* are provided as straps which, within the housing of the apparatus, are wound around drums which are rotated by the drive means whose movement is, in turn, determined by the position of the switch 5 and by which operating device is actuated. The drums are also provided with locking means which prevent the connecting devices 9*a,b* from being paid out uncontrollably when the straps are under load. Hereinafter, that connecting device 9*a* which cooperates with the first carriage 4*a* will generally be designated first connecting device 9*a*, and that connecting device 9*b* which cooperates with the second carriage 4*b* will generally be designated second connecting device 9*b*.

Figure 1:
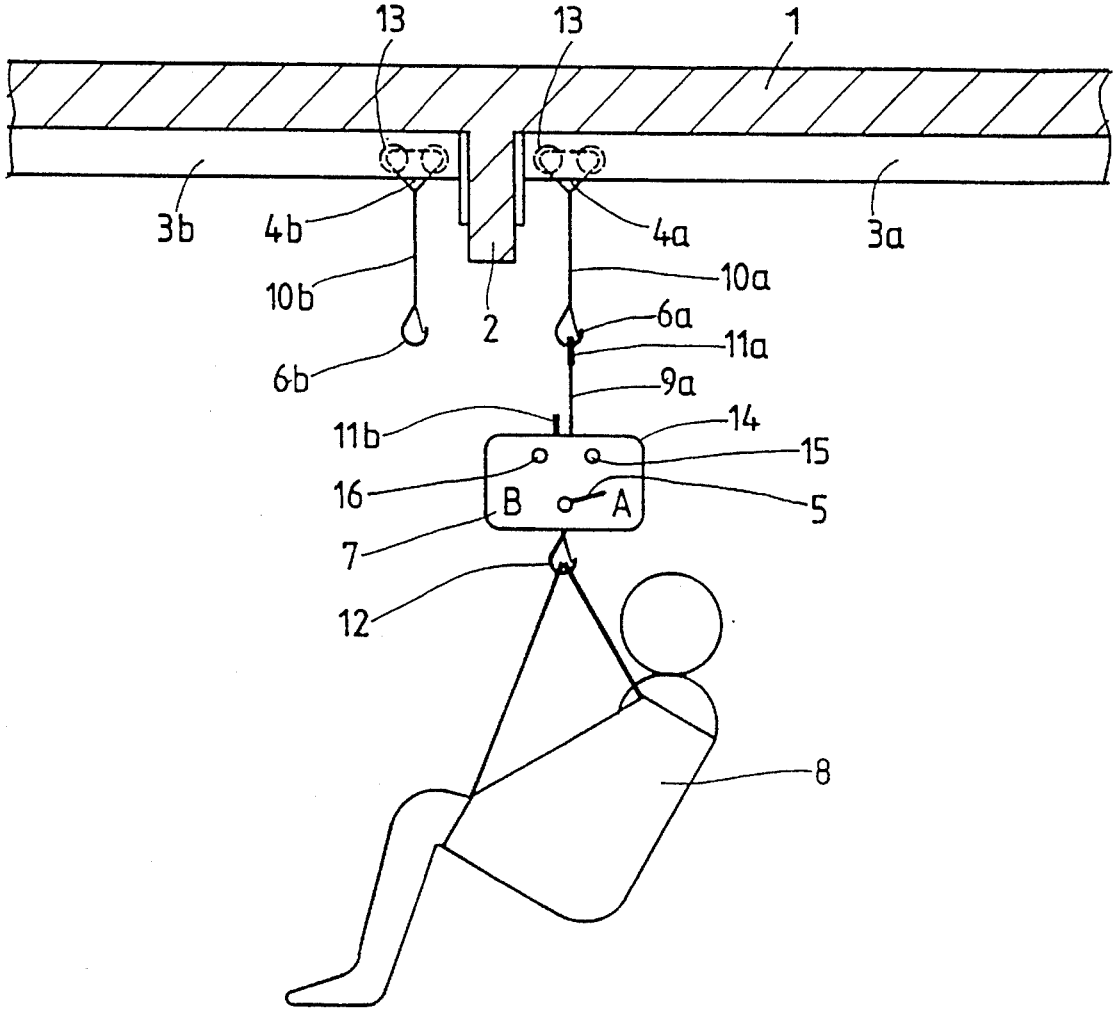
FIG. 1 shows an apparatus depending in a first path.
Figure 2:
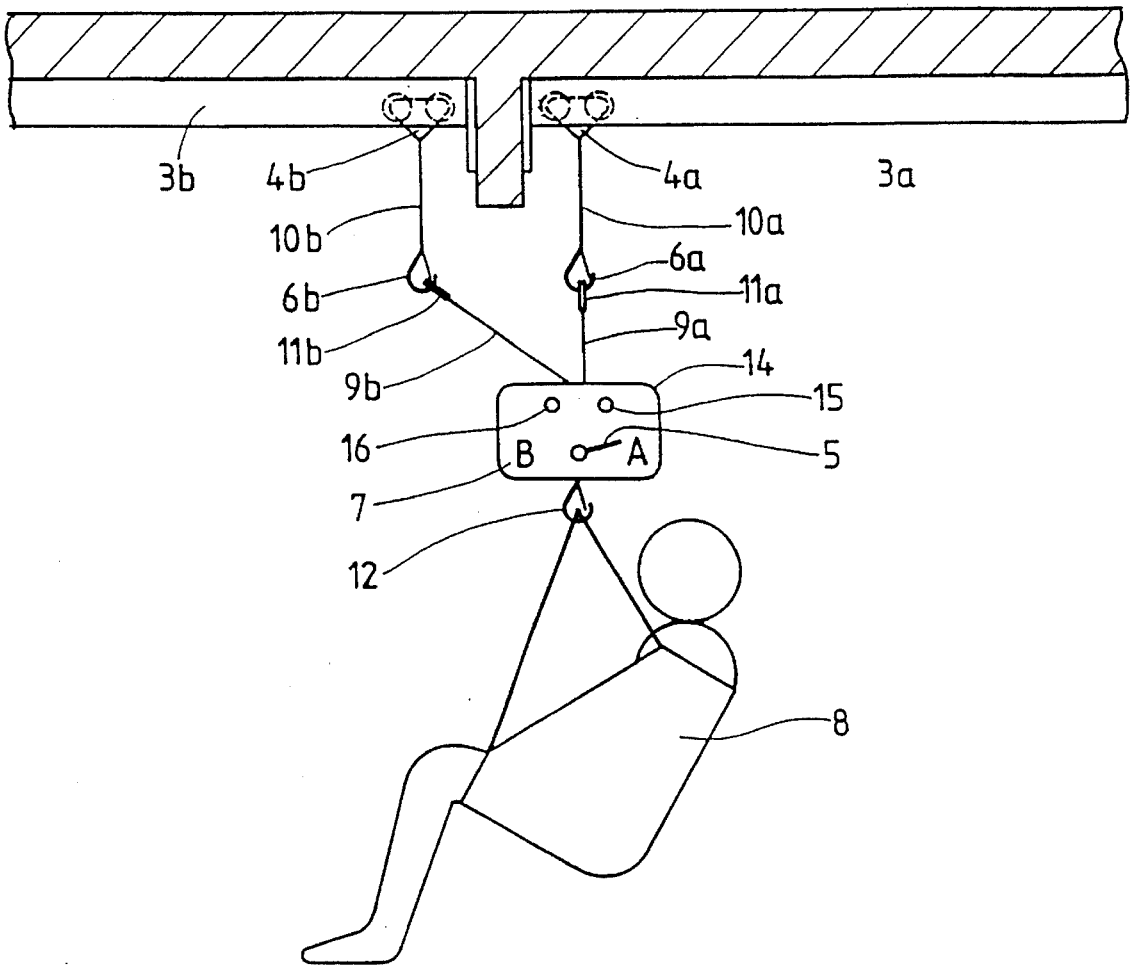
FIG. 2 shows the apparatus depending in the first path and interconnected with the second path.
Figure 3:
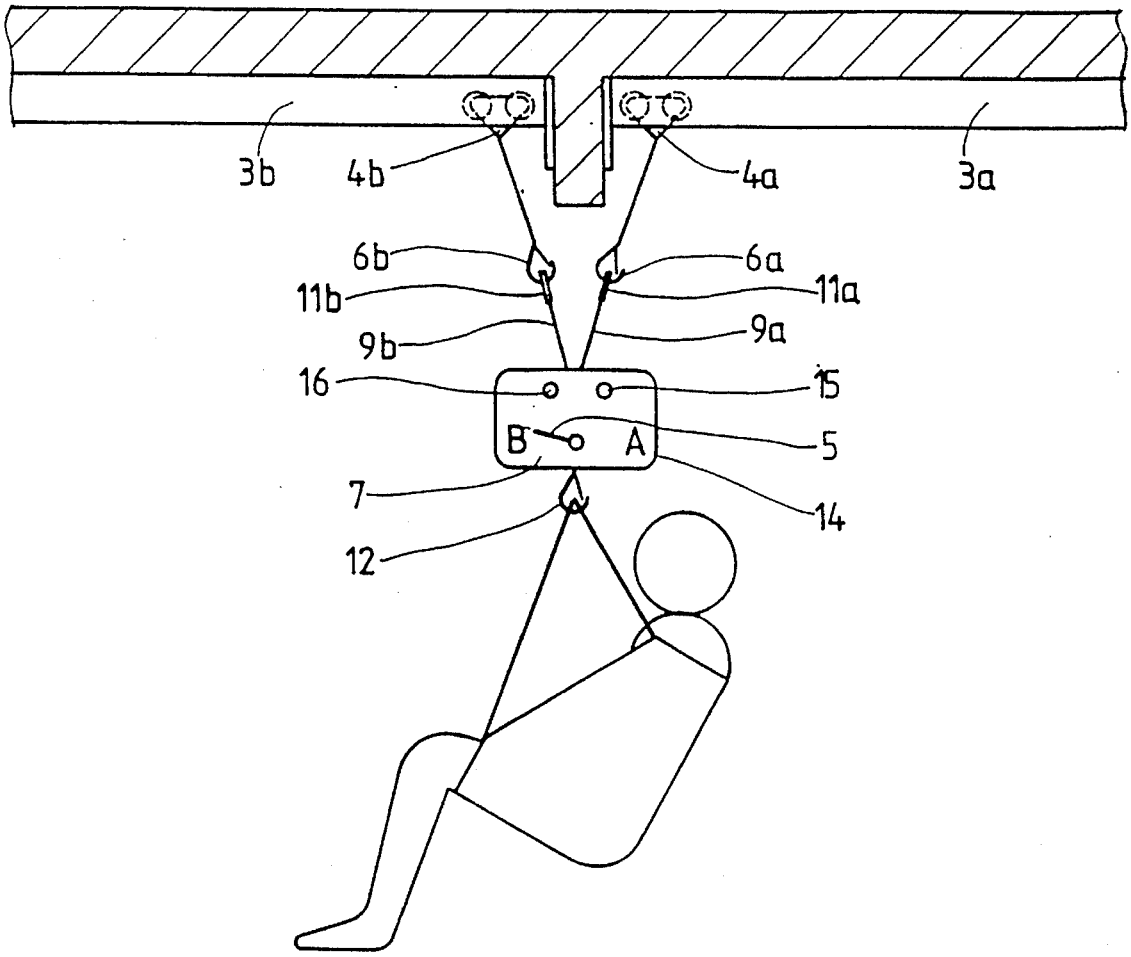
FIG. 3 shows the apparatus depending in both the first and the second path.
Figure 4:
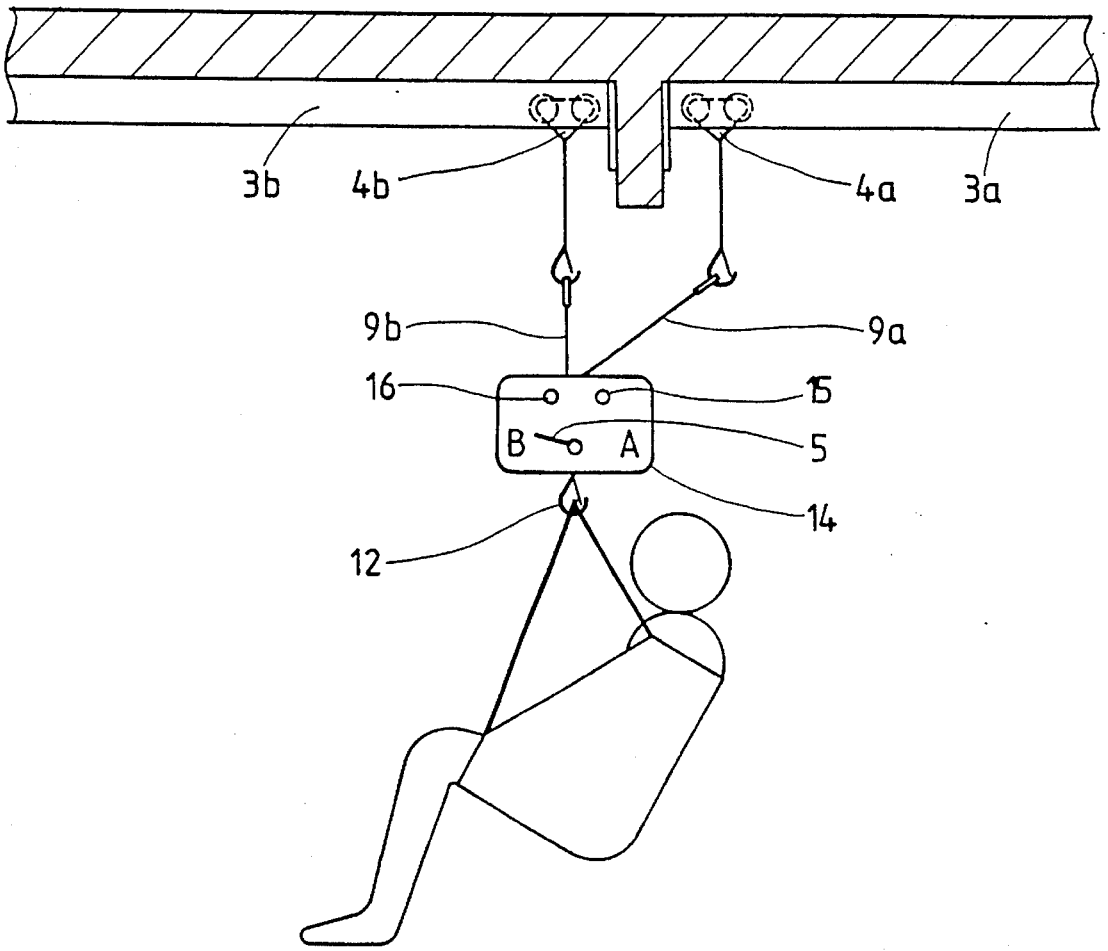
FIG. 4; shows the apparatus depending substantially in the second path.
Figure 5:
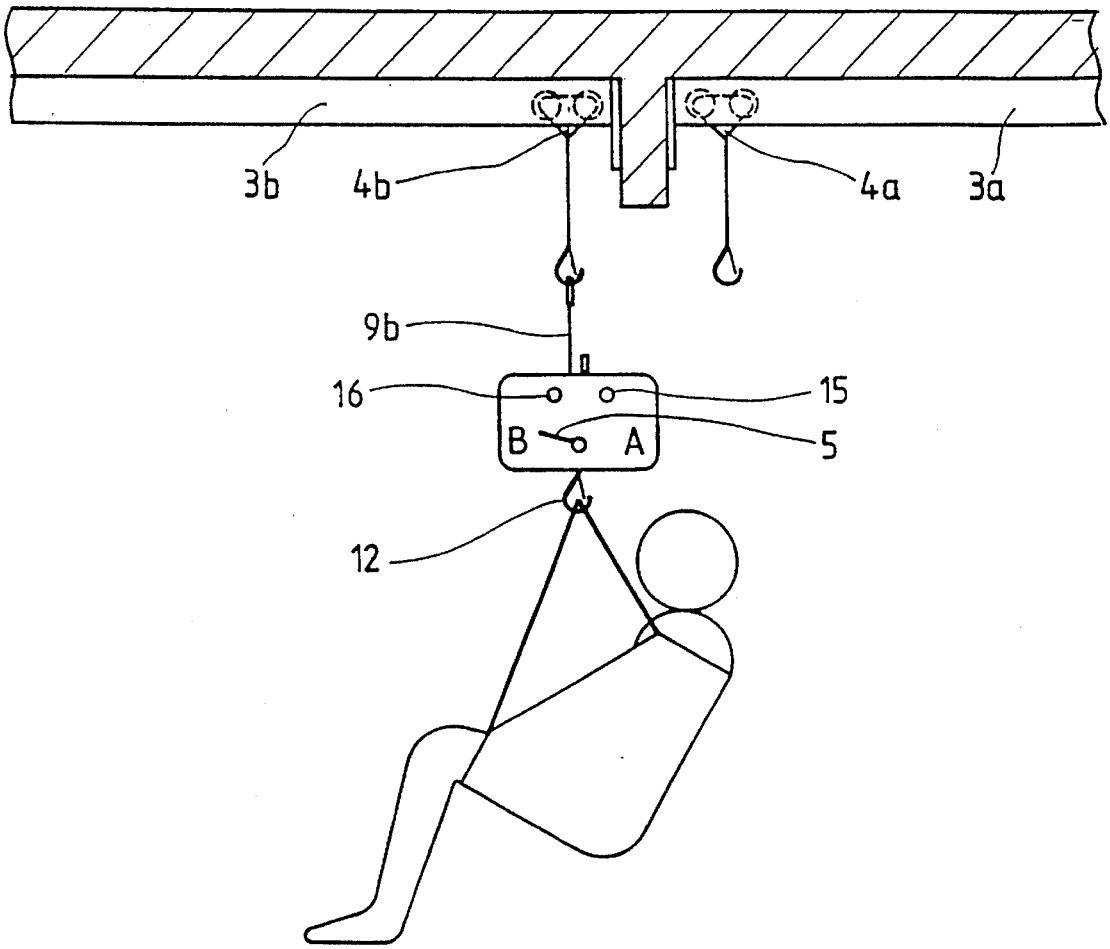
FIG. 5 shows the apparatus depending solely in the second path.
Figure 6:
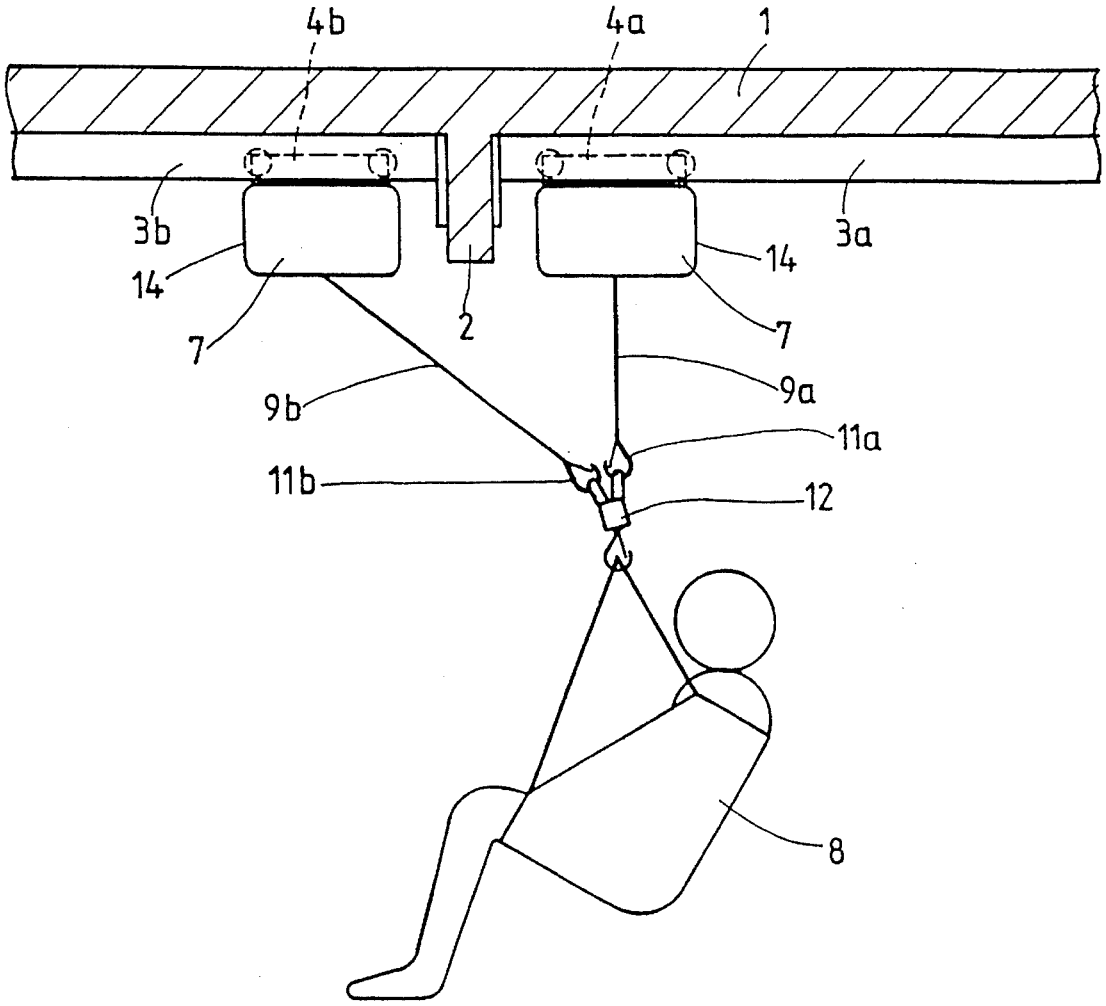
FIGS. 6–7 show the apparatus integrated with a carriage running in the path.
Figure 7:
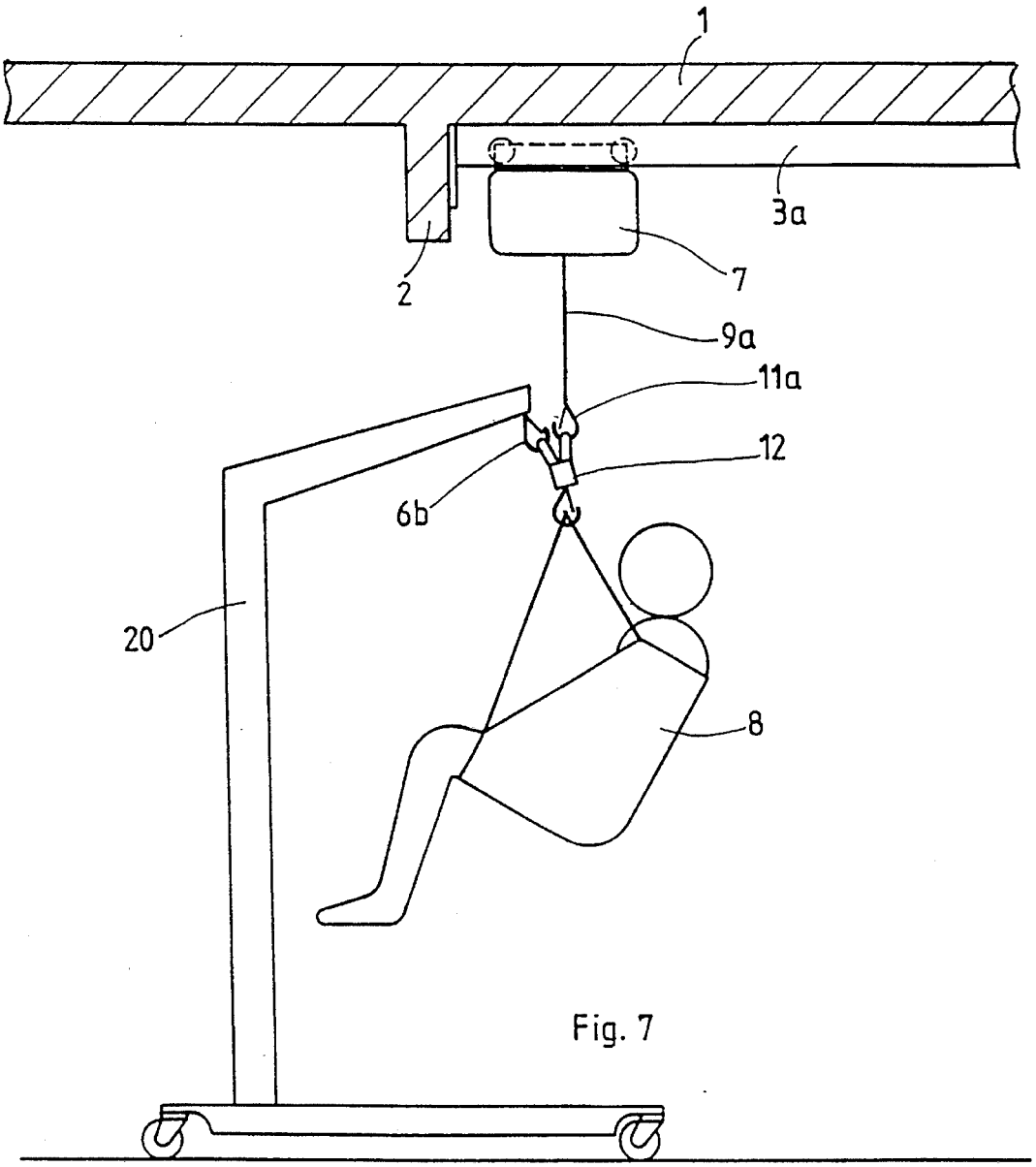

FIGS. 6 and 7 show embodiments of the present invention in which the apparatus 7 is integrated with the carriage 4*a,b* . FIG. 7 shows in particular how a patient is collected from a mobile transport facility 20. According to the embodiments shown in FIGS. 6 and 7, the connecting devices 9*a*, 11*a*;9*b*, 11*b* depend down from the apparatus 7.

When the apparatus according to the invention is reduced into practice, the patient is collected from a bed, wheel chair etc. with the aid of that chair, harness etc. which is suspended in the carrier member 12. The first carriage 4*a* (cf. FIG. 1) is displaced along the transport path 3*a* until such time as the carriage arrives at the descending wall portion 2. The second connecting device 9*b* is drawn out from the housing 14 of the apparatus and is interconnected (cf. FIG. 2) by means of the coupling device 11*b* with the interconnecting device 6*b* of the second carriage 4*b*. Thereafter, the switch 5 is set in position B (cf. FIG. 3), whereupon, when the operating device 15 for intake of the connecting device 9*b* is actuated, this is drawn into the housing 14 of the apparatus. Hereby, the distance between the carrier member 12 and the second carriage 4*b* is reduced. In one preferred embodiment, a certain generally corresponding pay-out of the first connecting device 9*a* takes place from the housing 14 of the apparatus so as to avoid a vertical displacement of the patient in connection with the intake of the second connecting device 9*b*, as the distance between the second carriage 4*b* and the carrier member 12 reduces, the load is progressively transferred to the second carriage so that, finally, this generally carries the entire load (cf. FIG. 4). When such is the case, the apparatus is disconnected from the first carriage 4*a* and the patient is wholly transferred to the second carriage for continued movement along the second carriage path 3*b* (cf. FIG. 5).

Even through the switch 5 and the operating device 15,16 in the Figures are shown as disposed on the housing 14, it will be obvious to a person skilled in the art that, in certain embodiments, these can be included in a device suspended from the housing. The suspended device makes it possible for the patient independently to manoeuver and operate the apparatus.

The above detailed description has referred to but a limited number of embodiments of the present invention, but it will readily be perceived by a person skilled in the art that the present invention accommodates a large number of embodiments without departing from the scope of the appended claims.

What is claimed is:

1. A method of transferring a load carried by a carrier member between first and second transport paths, said method comprising:

selectively suspending a carrier member with a load from a respective device displaceable in an associated one of first and second transport paths, supporting the carrier member and its load from said first transport path by a first connecting device transporting said carrier member along said first transfer path, by travel of the associated device along said first transport path, to a location at which transfer of the carrier member to said second path is to be carried out, connecting and supporting the load carrier from said second transport path by a second connecting device at said location at which transfer is to be made so that the load carrier is supported by both said first and second transfer paths, shifting the support provided for the load carrier and the load by the first transport path to the second transport path by reducing the length of at least one of the connecting devices, and disconnecting the first connecting device from the carrier member so that the load carrier is supported only by the second transport path via said second connecting device to achieve transfer of the load carrier to said second transport path for travel therealong.

2. A method as claimed in claim 1, comprising increasing the length of the other of said first and second connecting devices when the support of the load carrier is transferred to the second transport path.

3. A method as claimed in claim 2, comprising effecting the increase of the length of said other of the connecting devices and the reduction of the length of said one connecting device concurrently during the transfer of the support of the load carrier from the first transport path to the second transport path.

4. A method as claimed in claim 1, wherein the first and second transport paths are separated from one another at said location at which transfer is to be made of the support of the load carrier, said method further comprising supporting the load carrier beneath the first transport path at said location, displacing the load carrier to a position beneath the second transport path so that the load carrier is now supported by said second transport path whereafter the load carrier is disconnected from the first connecting device member and thereby from the first transport path.

5. A method as claimed in claim 1, comprising securing at least one of said transport paths to a ceiling.

6. A method as claimed in claim 5, comprising forming the other of said transport paths as a transport facility movable on a floor.

7. Load transport apparatus for a carrier member with a load, said apparatus comprising:

first and second separate transport paths, first and second displaceable devices respectively supported for displacement along said first and second transport paths, first and second connecting means for respectively suspending a carrier member from the first and second displaceable devices, each connecting means including a connecting device for connecting the carrier member to the respective displaceable device, and a releasable coupling for selectively connecting the respective connecting device to the respective displaceable device, at least one of said connecting devices having an adjustable length between its connection to the carrier member and to its respective displaceable device, said first and second transport paths being separated at a location at which transfer of the carrier member is to be made from the first transport path to the second transport path, said at least one of the connecting devices being changed in length to transfer the support of the carrier member from the first transport path to the second transport path after which the first connecting device can be disconnected from the first displaceable device by the respective releasable coupling.

8. Load transport apparatus as claimed in claim 7, further comprising a switching device switchable between two coupling positions in each of which a coupling means controls the displacement of the respective connecting device relative to the respective displaceable device.

9. Load transport apparatus as claimed in claim 8, wherein each transport path includes a rail and the associated displaceable device comprises a carriage displaceable along said rail.

10. Load transport apparatus as claimed in claim 8, comprising a housing supporting said carrier member therebelow, said connecting devices of said first and second connecting means being each connected to a respective said carriage and to said housing.

11. A method as claimed in claim 7, wherein one of said transport paths comprises a mobile load-carrying device for travel on a floor.

12. Load transport apparatus as claimed in claim 7, wherein the connecting devices of both said first and second connecting means have an adjustable length.

* * * * *